US005372644A

United States Patent [19]

Kochsmeier

[11] Patent Number: 5,372,644

[45] Date of Patent: Dec. 13, 1994

[54] APPARATUS FOR THE METERED COATING OF AN INKING ROLLER WITH A FLUID COATING MEDIUM

[76] Inventor: Hans-Hermann Kochsmeier, Bülstr. 26, D - 3400 Götingen, Germany

[21] Appl. No.: 987,626

[22] Filed: Dec. 9, 1992

[30] Foreign Application Priority Data

Dec. 11, 1991 [DE] Germany ..... 4140790
Mar. 31, 1992 [DE] Germany ..... 4210529

[51] Int. Cl.[5] ..... B05C 11/02

[52] U.S. Cl. ..... 118/46; 118/262; 118/258

[58] Field of Search ..... 118/46, 259, 262, DIG. 15; 101/350, 366; 242/76

[56] References Cited

U.S. PATENT DOCUMENTS

| | | | |
|---|---|---|---|
| 2,926,628 | 3/1960 | Black et al. | 118/262 |
| 3,559,572 | 2/1971 | Hackley | 118/262 |
| 3,701,335 | 10/1972 | Barnscheidt | 118/262 |
| 4,068,620 | 1/1978 | Peters | 118/262 |
| 4,211,167 | 7/1980 | Corse | 118/262 |
| 4,357,896 | 11/1982 | Feldkamper | 118/262 |
| 4,408,527 | 10/1983 | Bell | 101/350 |
| 4,428,291 | 1/1984 | Dorow | 101/350 |
| 4,977,830 | 12/1990 | Fadner | 101/350 |
| 5,103,759 | 4/1992 | Henseler et al. | 118/DIG. 15 |
| 5,122,396 | 6/1992 | Rantanen | 118/262 |
| 5,179,909 | 1/1993 | Sollinger | 118/262 |

*Primary Examiner*—Peter Chin
*Assistant Examiner*—Brenda Adele Lamb
*Attorney, Agent, or Firm*—Hopkins & Thomas

[57] ABSTRACT

An apparatus serves for the metered coating of an inking roller (1) with a fluid coating medium, in particular an inking roller in a printing press which directly or indirectly inks a printing form, whereby the inking roller (1) is in contact with a soft transfer roller (2) or soft printing roller arranged in parallel, and whereby the surfaces of the inking roller (1) and the transfer roller (2) or the printing roller respectively at least have a path speed which is more or less identical. The surface of the inking roller (1) dips directly into the coating medium (3), whereby the thickness of the film of coating medium (3) remaining on the surface of the inking roller (1) is determined by a wiping roller (4) which is arranged parallel to the inking roller (1), is supported on this, has an engraving and, in comparison to the inking roller, a small outside diameter.

9 Claims, 2 Drawing Sheets

APPARATUS FOR THE METERED COATING OF AN INKING ROLLER WITH A FLUID COATING MEDIUM

FIELD OF THE INVENTION

The invention refers to an apparatus for the metered coating of an inking roller with a fluid coating medium, in particular an inking roller in a printing press which directly or indirectly inks a printing form, whereby the inking roller is in contact with a soft transfer roller or soft printing roller arranged in parallel, and whereby the surfaces of the inking roller and the transfer roller or the printing roller respectively at least have a path speed which is more or less identical. One major application of such apparatuses is in inking systems for printing presses, whereby the coating medium is a printing ink. However, the apparatus can also, for example, be employed in the laminating of paper.

BACKGROUND OF THE INVENTION

In a flexographic printing system, the inking roller inks a soft printing roller directly, i.e. a soft printing form, while, for example, in offset printing, a soft transfer roller is provided between the inking roller and the hard printing roller or printing form respectively.

An apparatus of the above-mentioned type is known from U.S. Pat. No. 4,428,291. Besides an inking roller and a transfer roller it has a separate wetting (moistening) roller. The wetting roller is arranged parallel to the inking roller and the transfer roller. It is in contact with the inking roller, and the surfaces of the inking roller and the wetting roller have roughly the same path speed. An engraving in the form of little individual cups (indentations) is provided in the inking roller. These cups are filled with coating medium upon the inking roller making contact with the wetting roller. The cups serve for metering (supplying) the coating medium. For this, a wiper (stripper) blade in contact with the surface of the inking roller, is also provided. The wiper blade wipes off the coating medium from the inking roller which is in excess of that required to fill the engraving on the inking roller. The metered coating medium is then transferred to the transfer roller by means of contact with such. The arrangement of the inking roller in the known apparatus, also designated screen (raster) roller, is comparatively expensive. For wearing purposes, the inking roller has a ceramic surface. However, in order to ensure the desired wetting properties of the coating medium on the inking roller, the cups of the engraving on the inking roller are lined with copper. From this it is quite clear that as well as being comparatively large, the inking roller is a complicated and expensive component. The size of the inking roller also interferes with the changing of the roller for altering the metering of the coating medium.

SUMMARY OF THE INVENTION

It is, therefore, the object of the invention to demonstrate an apparatus of the aforementioned type in which the metering component can be manufactured cost-effectively and can be easily interchanged.

According to the invention this is achieved in that the surface of the inking roller dips directly into the coating medium, whereby the thickness of the film of coating medium remaining on the surface of the inking roller is determined by a wiping roller which is arranged parallel to the inking roller, is supported on this, has an engraving and, in comparison to the inking roller, a small outside diameter. The wiping roller thereby replaces both the engraving on the known screen roller and the wiper blade assigned to the screen roller. Nevertheless, an accurate and consistent metering of the coating medium is achieved. Therefore, the large and heavy inking roller can be advantageously constructed as a plain (smooth) roller and thus independent of the respective metering of the coating medium. For altering the metering, merely the comparatively small wiping roller, the diameter of which is normally 1 to 2 cm, needs to be exchanged for a different wiping roller having another engraving.

The engraving on the wiper roller which meters the coating medium in the new apparatus is of particular significance. Although there are wire strippers known for less accurate metering of coating mediums when laminating paper and consisting of a core with wire wound around it, these are not suitable for accurate metering of a coating medium. In particular, a high amount of wear on the wire and a metering which varies considerably with the working life of the wire stripper have been observed. This can be overcome by selecting a suitable engraving profile and a suitable material forming the surface of the wiping roller. For example, profiles which have proved to be suitable here are those which, in axial cross-section, have the shape of a rectangular or sine function. The depth of the engraving is in this case normally between 10 and 20 $\mu$m. This results in a coating medium film with an average thickness of a few $\mu$ m on the inking roller. This matches, for example, the requirements for offset printing exactly.

The surface of the wiping roller can have a lower path speed in comparison to the surface of the inking roller. Basically, it is, therefore, advisable to allocate a drive to the wiping roller as well so that this all sides are used equally during its working life, in other words to considerably increase the maximum working life. When selecting the path speed for the surface of the wiping roller no attempt should be made to reach the path speed of the inking roller. This would mean an extreme rotational speed for the wiping roller with the given circumference relationships. It is also essential that in doing this the metering action of the wiping roller is not impaired. Consequently, a particularly accurate metering of the coating medium is the result if the surface of the wiping roller has a path speed acting in the opposite direction to the inking roller. In addition, by altering the path speed of the wiping roller in terms of absolute value and direction, the metering of the coating medium as such can be adjusted within certain, albeit confined limits.

As already mentioned, the inking roller in the new apparatus can be advantageously constructed as a simple plain roller. In doing this, the friction between the inking roller and the wiping roller, determined by the smoothness of the surface of the inking roller, influences very considerably the wear on the wiping roller and also that on the inking roller itself. However, this is of minor importance with the large diameter involved here.

For an easier transfer of the coating medium from the inking roller onto the transfer roller or the printing roller respectively, it is advantageous if the surface of the inking roller exhibits hydrophobic properties or a lack of affinity for water.

Suitable materials for the surface of the inking roller are, according to the field of application of the apparatus, metals, ceramics, alloys, rubber and synthetic material. The alloys include metal and ceramic as well as metal-ceramic forms. The choice of material for the surface of the inking roller has to be made made under consideration of the abrasion resistance and the wetting properties of the material by the coating medium.

It is advantageous if the surface of the wiping roller is made from a material which is highly resistant to abrasion, in particular a ceramic. The lower the friction of the wiping roller, the less variation in metering of the coating medium over the working life of the wiping roller.

The wiping roller may have a helical engraving, an engraving made up of grooves running around the circumference in rings, or an engraving made up of independent indentations not running right around the circumference. The distribution of the engraving over the surface of the wiping roller also influences the accuracy of the metering of the coating medium. Furthermore, it influences the distribution of the wear over the surfaces of the wiping roller and the inking roller.

Special demands are then placed on the engraving on the wiping roller if the wiping roller is provided for one-sided sealing of a tank containing the coating medium. In this case, the complete tank can only be sealed too by sealing the rotating wiping roller. However, by sealing the tank a mainly closed system for the free coating medium can be made available. Here, the tank can be sealed on the side opposite to the wiping roller, for example, with the aid of a blocking stripper opposite to the inking roller. Such a sealed tank can be arranged at any random point on the outer periphery of the inking roller. Furthermore, the coating medium can be placed under pressure in the tank in order to improve the desired wetting of the inking roller with the coating medium.

With wider inking and transfer rollers and for applying various coating mediums, the tank can be subdivided in the axial direction of the wiping roller. However, in doing this it is advantageous to provide a continuous wiping roller. This eases, on the one hand, exchanging said roller and, on the other, only one single drive need to be present for the wiping roller. However, independent metering of the individual coating mediums in the various tanks can only be achieved if the wiping roller is also subdivided.

BRIEF DESCRIPTION OF THE DRAWINGS

In the following the invention is described and explained in more detail by means of two embodiment examples. They show.

DETAILED DESCRIPTION

Figure 1:
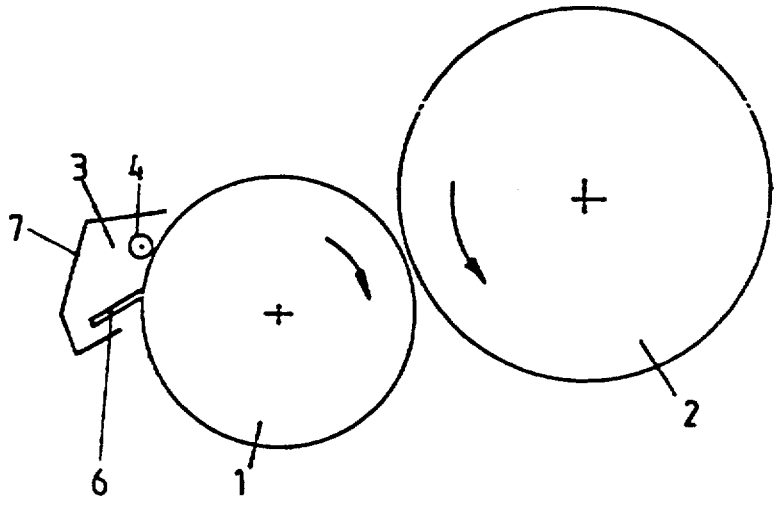
FIG. 1 a schematic cross-section of a first embodiment version of the apparatus for the metered coating of an inking roller, FIG. 2 a detail of the apparatus according to FIG. 1, FIG. 3 a further detail of the apparatus according to FIG. 1, FIG. 4 a detail of a second embodiment version of the apparatus for the metered coating of an inking roller, and FIG. 5 a further embodiment version of the apparatus for metered coating.

The apparatus for the metered coating of an inking roller 1 illustrated in FIG. 1 is a component of a printing press and can also be designated as its inking system. Arranged parallel to the inking roller 1 is a transfer roller 2 which is in contact with the inking roller 1. The path speeds of the surfaces of the inking roller 1 and the transfer roller 2 are the same. The inking roller 1 is constructed as a plain roller, the surface of which dips into a tank 7 containing a coating medium 3.

Figure 2:
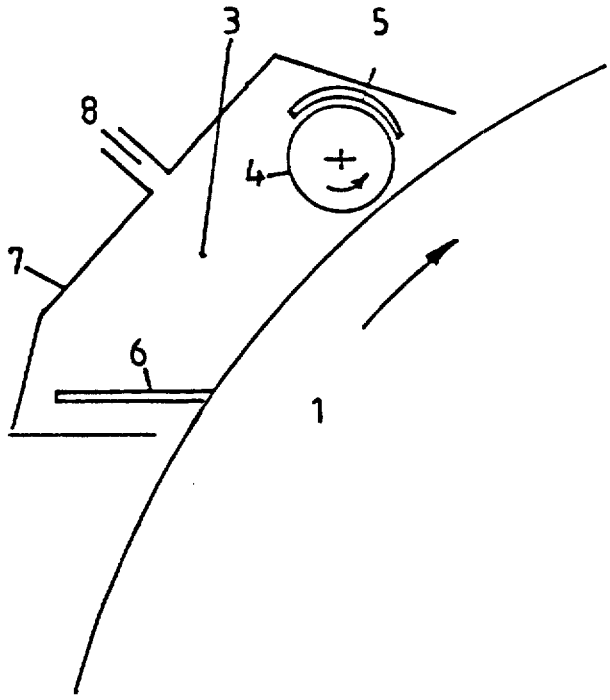

This can be seen more clearly in FIG. 2. The tank 7 has a supply 8 for the coating medium and is sealed opposite the inking roller 1 using a wiping roller 4 and a blocking stripper 6. Here, the blocking stripper 6 and the wiping roller 4 are arranged in line with the rotational direction of the inking roller 1. The presence of the wiping roller 4 means that the tank 7 is not completely sealed because said roller has an engraving 9 through which a precisely metered amount of the coating medium 3 passes so that it can remain on the surface of the inking roller. This quantity of coating medium 3 is then transferred from the inking roller 1 to the transfer roller 2. The wiping roller 4 is provided with a drive, not illustrated here, with which the adjustable speed and adjustable direction of rotation can be set. In doing this, the rotational speed of the surface of the wiping roller 4 is to be adjusted with respect to the surface of the inking roller 1 so that it matches the accuracy of the metering of the coating medium, but also the metering of the coating medium as such. If the surfaces of the wiping roller 4 and the inking roller 1 have path speeds running in the same direction in the region of contact, then the metering of the coating medium is comparatively high, while with path speeds running in opposite directions it is comparatively low. In this direction, however, the accuracy of the metering also rises. A seal 5 is provided for sealing the rotating wiping roller 4 with respect to the tank 7, whereby said seal surrounds the wiping roller on the side opposite to the inking roller tightly and flexibly. The wiping roller 4 together with the tank 7 are pressed against the inking roller 1 with a constant force by means of springs, not illustrated here, in order to ensure a constant distance between the surface of the inking roller 1 and the engraved surface of the wiping roller 4.

Figure 3:
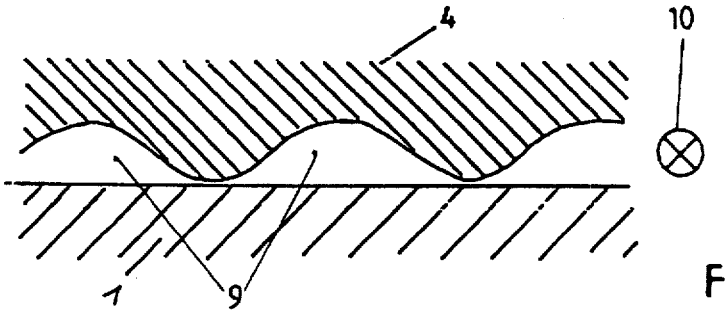

An example of the engraving 9 on the wiping roller 4 can be seen in FIG. 3. Here, the contact region between the wiping roller 4 and the inking roller 1 is reproduced in a greatly enlarged longitudinal section. The actual depth of the engraving 9 is normally between 10 and 20 μm. A symbol 10 in FIG. 3 indicates the running direction for the surface of the inking roller 1 which corresponds to the outlet (discharge) direction of the coating medium 3 from the tank 7 according to FIG. 2. The contour (profile) of the engraving 9 according to FIG. 3 is shaped as a sine (sine wave). Here, a single helical groove running around the wiping roller 4 is provided. This leads to more even frictional wear on the inking roller 1 than, for example, an engraving formed by ring-type circumferential grooves. Besides a sine-shaped contour for the engraving 9, engravings with the shape of a rectangular function are also especially suitable for the wiping roller 4.

Figure 4:
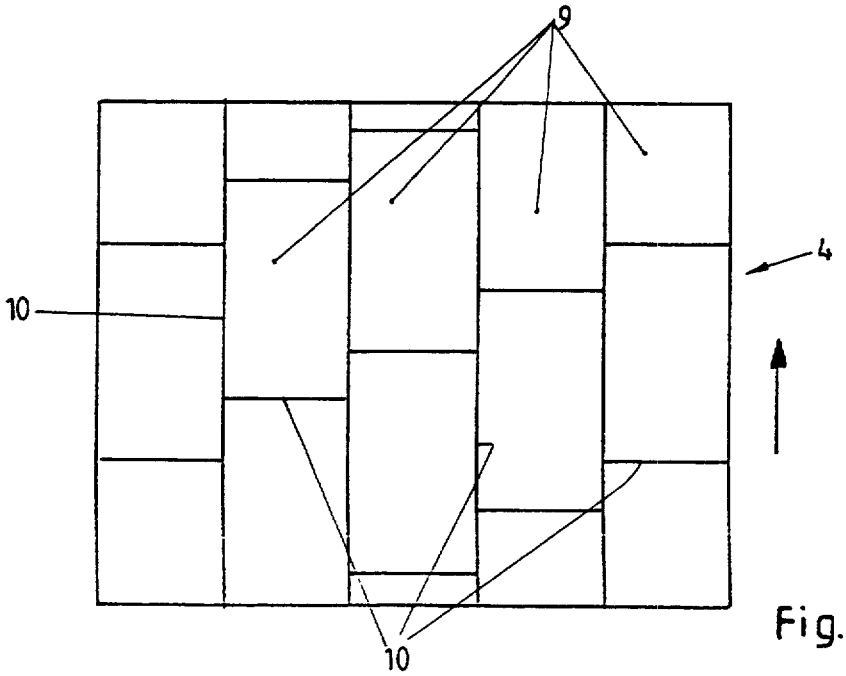

Such an engraving is shown in FIG. 4, whereby FIG. 4 reproduces an enlarged part of the surface of the wiping roller 4. However, the engraving 9 consists of independent indentations not running right around the circumference and confined on all sides by spacers 11. Owing to this, it is easier in certain cases to realize the seal for tank 7 according to FIG. 2 in the area of the seal 5.

Figure 5:
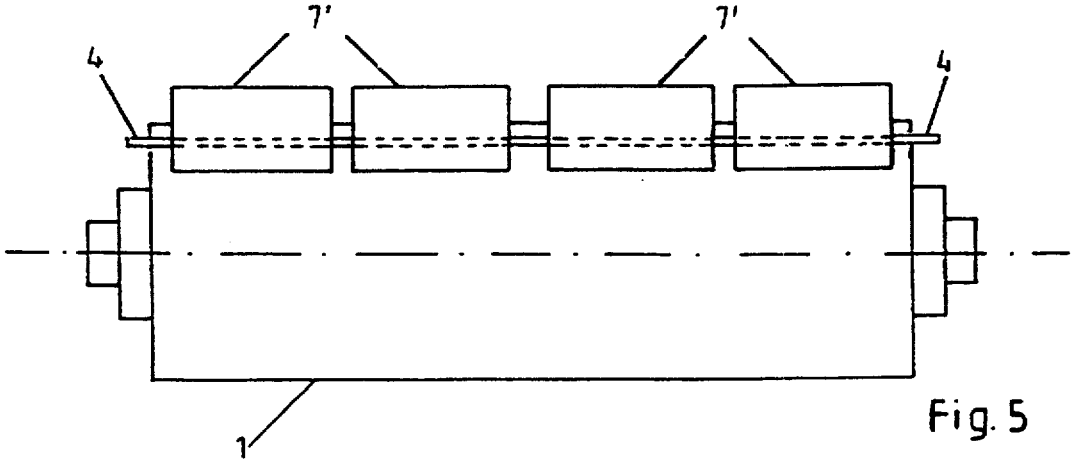

The embodiment version of the apparatus for the metered coating of an inking roller according to FIG. 5 can be distinguished from those according to FIGS. 1 and 2 by the subdivision of the tank 7 in the axial direction of the wiping roller 4. In the case under consideration, four separate tank divisions 7' are provided. In this way the area of the inking roller 1, or the downstream transfer roller 2 respectively, onto which the coating medium is to be transferred can be selected. Apart from that, various coating mediums can be employed simultaneously. The wiping roller 4 in the embodiment version according to FIG. 5 is constructed as a continuous element in order to ease its interchange. However, if the contents of the individual tank divisions 7' are to be delivered with different meterings, then a separate wiping roller, with an engraving determining the metering, must be provided for each tank division 7'.

Furthermore, a separate drive for each wiping roller for each tank division 7' also permits sensitive (fine) adjustment of the metering in each individual case through the rotational speed of the wiping roller 4.

While preferred embodiments of the invention have been disclosed herein, it will be understood by those skilled in the art that variations and modifications thereof can be made without departing from the spirit and scope of the invention as described in the following claims.

I claim:

1. A printing apparatus, comprising:

a rotatable inking roller having a smooth cylindrical surface, wherein the surface of said inking roller is comprised of a material selected from the group consisting of metal, ceramic, and alloy;

a tank applied to the cylindrical surface of said rotatable inking roller having a first end and a second end for containing a coating medium in which said inking roller is dipped such that said coating medium coats the dipped portion of said inking roller as said inking roller rotates;

a wiping roller positioned in said tank and having a cylindrical surface applied to said inking roller, and a wiping roller seal applied to said wiping roller, that together seal the first end of said tank with respect to the cylindrical surface of said inking roller, said wiping roller having indentations which form high and low areas in the cylindrical surface of said wiping roller which engage said inking roller for metering the amount of the coating medium on said inking roller; and a blocking stripper that seals the second end of said tank with respect to the cylindrical surface of said inking roller.

2. A printing apparatus, comprising:

an inking roller having a smooth surface;

a tank having a first end and a second end applied to said roller and for containing a coating medium in which said inking roller is dipped such that said coating medium coats the dipped portion of said inking roller;

a wiping roller that seals the first end of said tank to said inking roller and having raised surface areas contacting said inking roller and lower surface areas intermediate said raised surface areas such that said raised surface areas and said lower surface areas of said wiping roller meter the amount of coating medium on said inking roller;

a blocking stripper that seals the second end of said tank and contacts said inking roller; and a wiping roller seal partially surrounding said wiping roller for sealing the wiping roller with respect to said tank.

3. The printing apparatus of claim 2, wherein said wiping roller has a lower surface speed than surface speed of the inking roller.

4. The printing apparatus of claim 2, wherein direction of movement of the surface of the wiping roller is opposite to direction of the movement of an adjacent surface of the inking roller.

5. The apparatus of claim 2, wherein the smooth surface of the inking roller lacks an affinity for water.

6. The printing apparatus of claim 2, wherein the smooth surface of the inking roller is comprised of a material selected from the group consisting of metal, ceramic, and alloy.

7. The printing apparatus of claim 2, wherein the raised surface areas and the lower surface areas of the wiping roller are ceramic.

8. The printing apparatus of claim 2, wherein said wiping roller is elongated and said tank is subdivided into a plurality of separate tanks positioned along the length of said wiping roller.

9. A printing apparatus, comprising:

a rotatable inking roller having a smooth cylindrical surface;

a tank applied to the cylindrical surface of said rotatable inking roller having a first end and a second end for containing a coating medium in which said inking roller is dipped such that said coating medium coats the dipped portion of said inking roller as said inking roller rotates;

a wiping roller positioned in said tank and having a cylindrical surface applied to said inking roller, and a wiping roller seal applied to said wiping roller, that together seal the first end of said tank with respect to the cylindrical surface of said inking roller, said wiping roller having indentations which engage said inking roller for metering the amount of the coating medium on said inking roller; and a blocking stripper that seals the second end of said tank with respect to the cylindrical surface of said inking roller;

wherein said wiping roller is elongated and said tank is subdivided into a plurality of separate tanks positioned along the length of said wiping roller.

* * * * *